US005408289A

United States Patent [19]

Green et al.

[11] Patent Number: 5,408,289

[45] Date of Patent: Apr. 18, 1995

[54] SCANNER FOR PHOTOGRAPHIC PROCESSOR

[75] Inventors: Andrew Green, Harrow, England; Gerhard Uffinger, Weinstadt-Grossheppach; Gerd Hoitz, Unterensingen, both of Germany

[73] Assignee: Eastman Kodak Company, Rochester, N.Y.

[21] Appl. No.: 159,893

[22] Filed: Nov. 30, 1993

[30] Foreign Application Priority Data

Dec. 2, 1992 [DE] Germany ..... 92 16 366 U

[51] Int. Cl.[6] ..... G03D 13/00; G03D 13/02

[52] U.S. Cl. ..... 354/298; 354/334; 250/205.3; 250/560; 250/561

[58] Field of Search ..... 354/298, 334, 319–323; 355/40.41; 250/208.1, 208.3, 557, 559, 560, 561, 571

[56] References Cited

U.S. PATENT DOCUMENTS

| | | | |
|---|---|---|---|
| 3,559,555 | 2/1971 | Street | 354/298 |
| 3,623,418 | 11/1971 | Ost | 354/320 |
| 4,134,663 | 1/1979 | Laar et al. | 354/298 |
| 4,293,211 | 10/1981 | Kaufmann | 354/298 |
| 4,314,753 | 2/1982 | Kaufmann | 354/321 |
| 4,603,956 | 8/1986 | Baker | 354/298 |

FOREIGN PATENT DOCUMENTS 3142881 10/1981 Germany .

*Primary Examiner*—D. Rutledge
*Attorney, Agent, or Firm*—Frank Pincelli

[57] ABSTRACT

A scanner for photographic processors wherein density and surface area determinations of the photosensitive materials can be exactly and reliably determined within a large density range. Optoelectronic sensor elements are arranged in the scanner which are formed of a transmitted light operated IR transmitter/receiver arrangement and of an IR reflective sensor arrangement located in rows and alternating across the width of the scanner.

2 Claims, 2 Drawing Sheets

SCANNER FOR PHOTOGRAPHIC PROCESSOR

FIELD OF THE INVENTION

The invention relates to a scanner for a photographic processor by means of which replenishment of the processing solutions is controlled in response to the density and surface area of the photosensitive material moved through said solutions in that for detecting the width, length and density of the photosensitive material signals are produced by means of optoelectronic sensor elements and fed to a control unit.

BACKGROUND OF THE INVENTION

A device of this type for determining the replenishment of developer, fixing and water baths based on the detection of the film surface area is, for example, known from DE-PS 31 42 881 by means of which the width of the photosensitive material is detected by a large number of IR transmitters and receivers and the length is detected by determining the transport speed.

DE-PS 31 27 822 discloses an automatically operating replenishing system for processing solutions in a processing unit for photosensitive material in which the surface area of the photosensitive material is calculated by means of a number of sensors sensing the film width and by determining the film transport speed with the aid of a microcomputer.

From DE-PS 25 57 253 it is known that for sensing the length of sheets and web-shaped material a buffer lift is provided at whose direction reversal points switching elements are arranged the time-related actuation of which is indicative of the transport speed of the film material and thus indicative of the length of the material.

All those devices are disadvantageous in that for determining the transport speed of the photosensitive material either the processor produces a signal corresponding to the transport speed by measuring the rotational speed of a shaft or of the drive motor, or the control means itself of the processor delivers such a signal. In both cases the transport speed of the photosensitive material moved through the processor cannot be determined directly and, as a result, an exact determination of the surface area and thus of the amount of the replenisher required is not possible.

For determining the density of the photosensitive material a number of methods are known, e.g. from U.S. Pat. No. 3,623,418 in which a process control strip is initially exposed, developed and then fed to a IR measuring unit for determining the density. The density is compared with a nominal value, deviations from said value causing the valve of a supply tank to open or close for replenishing developer or fixing solution.

It is a disadvantage of the aforementioned method that for maintaining top processing quality of the photographic material process control strips are exposed and developed at periodic intervals so that no continuous control of the processing solutions is possible.

Moreover, the known methods and devices have the disadvantage that photosensitive materials having only very slight differences in density are not clearly detected and thus the processing solutions are not correctly replenished. This is the case, if the optoelectronic sensors in the density measuring unit have to differentiate between "unexposed film" and "no film at all". Due to noise, temperature influences or suchlike, the sensor signals may reach an intensity erroneously indicating the presence of a film of low density. For the same reason, a determination of film width and length may be incorrect. On the one hand, a material might be indicated where there is none and, on the other, a film of low density might not be detected.

SUMMARY OF THE INVENTION

It is the object of the present invention to provide a scanner for photographic processors by means of which density and surface area determinations of the photosensitive materials can be exactly and reliably performed within a large density range.

According to the invention, the above object is attained in that optoelectronic sensor elements are arranged in the scanner which are formed of a transmitted light operated IR transmitter/receiver arrangement and of an IR reflective sensor arrangement located in rows and alternating across the width of the scanner.

Further developments of the invention are given in the subclaims.

BRIEF DESCRIPTION OF THE DRAWINGS

The invention is described with reference to the drawings wherein.

DETAILED DESCRIPTION OF THE INVENTION

Figure 1:
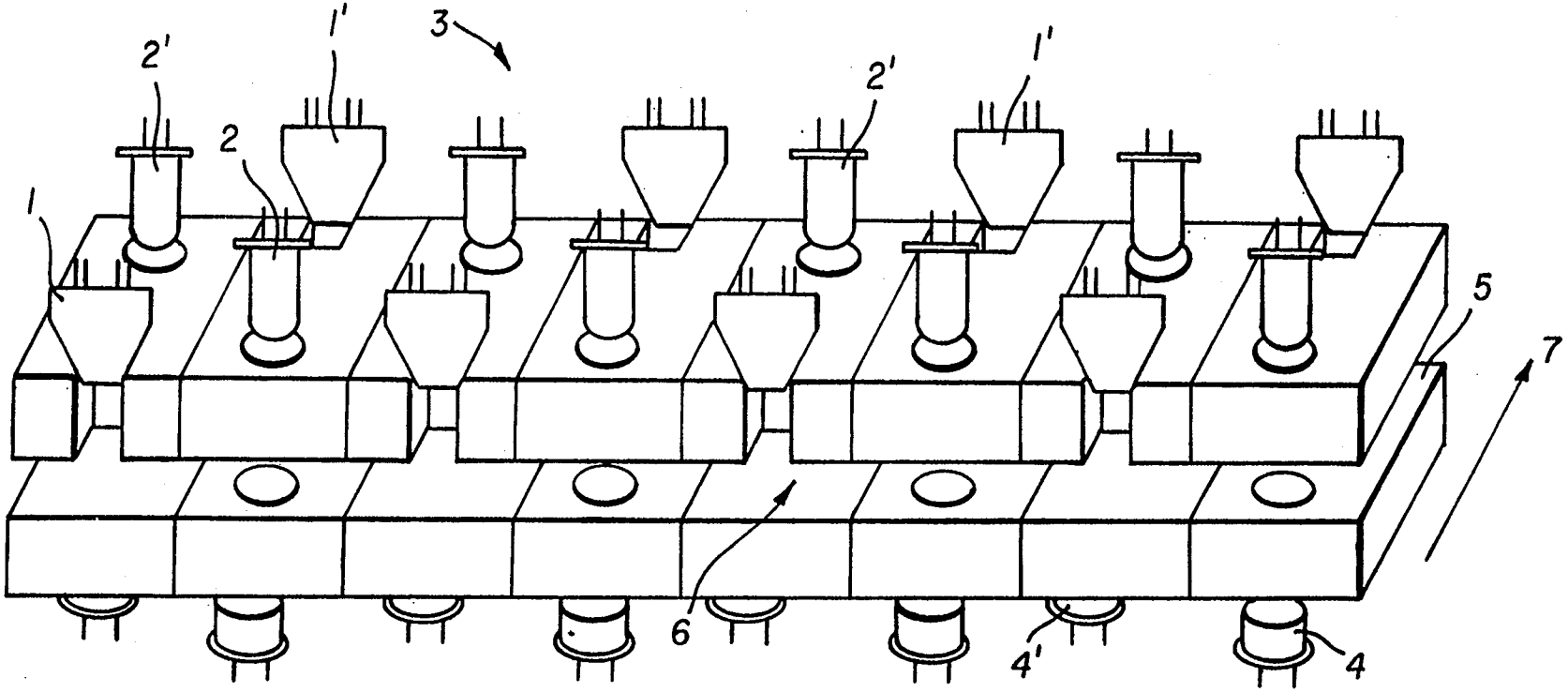
FIG. 1 shows the general apparatus made in accordance with the present invention.
Figure 2:
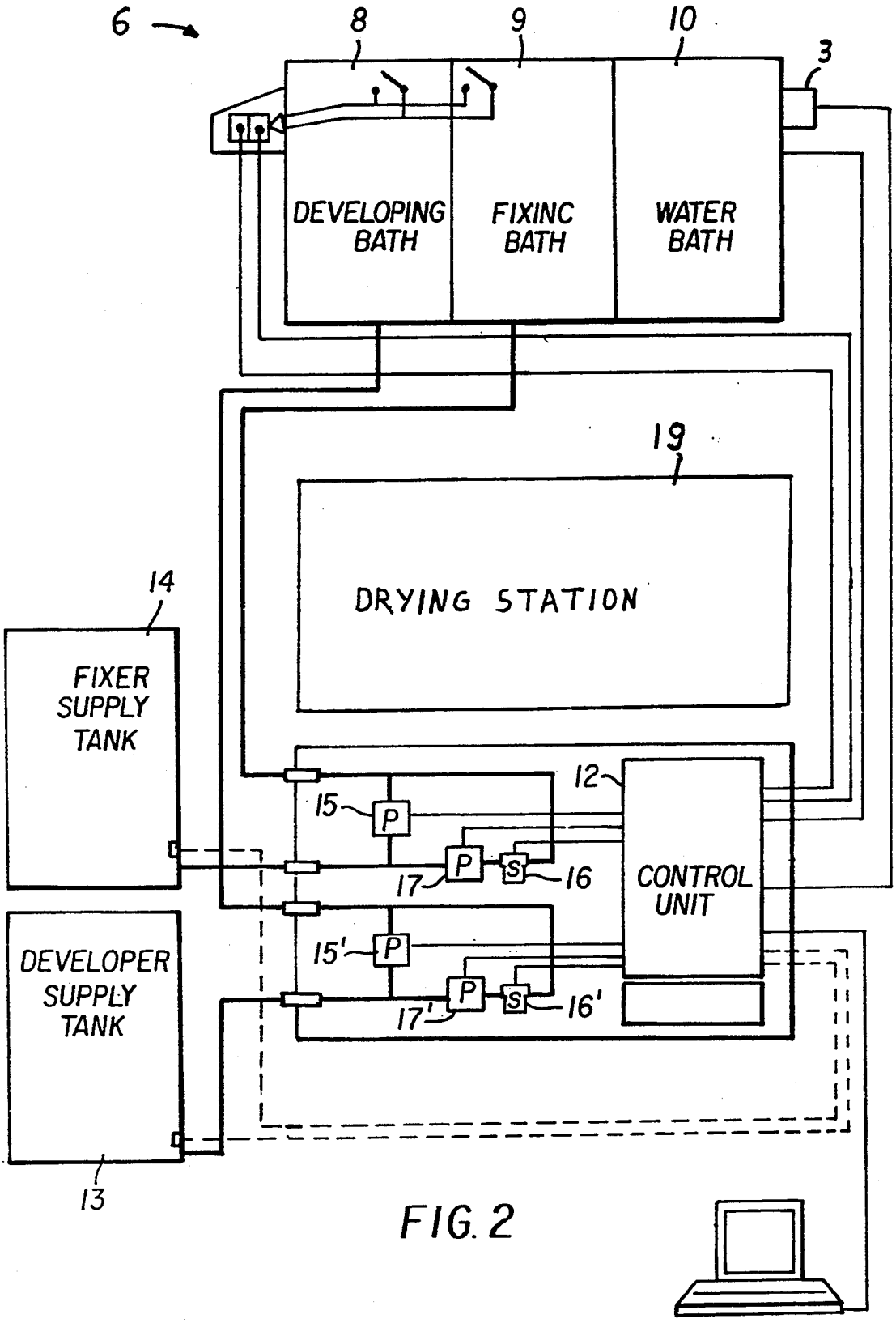
FIG. 2 shows a schematic illustration of a a known processor with the scanner according to the invention incorporated therein.

In transport direction 7 of the photosensitive material the scanner 3 comprises two rows of IR transmitters 2, 2' with oppositely arranged receivers 4, 4' and IR reflective sensors 1, 1' spaced at regular intervals. Arrangement of the IR sensors with respect to the longitudinal side 6 of the scanner is such that in each of the two rows an IR transmitter 2, 2' with a receiver 4, 4' is followed by an IR reflective sensor 1, 1'. The IR transmitters 2, 2' consist of infrared LED's and the receivers 4, 4' are formed of photocells. Across the total width of scanner 3, eight IR transmitter/receiver sensors and eight IR reflective sensors are arranged per row, the drawing showing only half the number of sensors. By means of rollers not illustrated the sensitive material is moved through slot 5 in direction 7.

The scanner 3 is placed downstream of a processor 6 consisting of developing 8, fixing 10 and water baths 12, a drying station 19, supply containers 13, 14 provided with pumps 15, 15', 17, 17' and valves 16, 16' for replenishing processing solutions, and a microprocessor control unit.

The photosensitive material, film or paper, moves through the processor in a known way, that is to say from the developing to the fixing bath, the water bath and then to the drying station from which it is advanced into slot 5 of scanner 3. As soon as the leading edge of the material moves beneath the first row of the reflective IR sensors I a signal is produced and a time measurement is started by the microprocessor control unit. Then the density of the photosensitive material is measured by the transmitted light operated IR transmitter/-receiver sensors 2, 2' and 4, 4'. When the leading edge of the material moves through the IR reflective sensors 1' in the second row, the time lapsed since the start of the time measurement is determined. Using the values from the time lapse and the known spacing between the first and second row of the IR reflective sensors 1, 1', the transport speed is calculated.

The width of the film or paper is determined from the number of IR transmitter/receiver sensors 2, 4 and 2', 4' that detect light reflected by the material and produce a signal. When the trailing edge of the material moves through the first row of the IR reflective sensor, time measurement is terminated. The total time then corresponds to the duration the film has taken to move through the processing solutions by means of which value the length of the material is calculated in response to the transport speed. The surface area processed will result from the length and width of the material.

During the time the material moves between the IR transmitter/receiver sensors 2, 2' and 4, 4' the density is determined. If no spot of the material shows a density below a predetermined value stored in the control unit, the type of the material, film or paper, can be determined. The surface area, density and type of material being known, the microprocessor control unit calculates, by means of a program stored therein, the required amounts of developing and fixing solutions as well as the amount of water necessary for washing. Depending on the amounts calculated, the replenishing pumps for developer, fixer and water are switched on for a predetermined period.

The design of the scanner is not restricted to the number of the IR transmitter/receiver sensors and reflective sensors which can also be increased as required.

Parts List

1,1' . . . IR reflector sensors
2,2' . . . IR transmitters
3 . . . scanner
4,4' . . . receivers
5 . . . slot
7 . . . transport direction

We claim:

1. A scanner for use in a photographic processor for detecting the width, length and density of a photosensitive material passing through the photographic processor, said scanner having optoelectronic sensor elements for producing signals for controlling replenishment of processing solution in the processor in response to the density and surface area of the photosensitive material that has been passed through the processing solution, characterized in the optoelectronic sensor elements are formed of a transmitted light operated IR transmitter/-receiver arrangement and of an IR reflective sensor arrangement which are located in rows and alternate across the width of the scanner.

2. A scanner according to claim 1, further characterized in that in the transport direction of the photosensitive material the scanner comprises at least two rows of alternately arranged IR transmitter/receiver arrangements and IR reflective sensor arrangements and in that each row is formed of at least eight IR transmitter/-receiver units and eight IR reflective sensors.

* * * * *